United States Patent [19]

Jones et al.

[11] Patent Number: 4,597,889

[45] Date of Patent: Jul. 1, 1986

[54] HOMOGENEOUS LAUNDRY DETERGENT SLURRIES CONTAINING POLYMERIC ACRYLIC STABILIZERS

[75] Inventors: Charles E. Jones, Yardley, Pa.; Bette-Jean Brabant, Mercerville, N.J.

[73] Assignee: FMC Corporation, Philadelphia, Pa.

[21] Appl. No.: 645,588

[22] Filed: Aug. 30, 1984

[51] Int. Cl.[4] ..... C11D 3/075; C11D 3/37; C11D 17/08

[52] U.S. Cl. ..... 252/135; 252/156; 252/173; 252/174.14; 252/174.18; 252/174.21; 252/174.24; 252/174.25; 252/DIG. 14

[58] Field of Search ..... 252/135, 156, 174.14, 252/174.24, 173, 174.18, DIG. 14, 540

[56] References Cited

U.S. PATENT DOCUMENTS

| | | | |
|---|---|---|---|
| 2,798,053 | 7/1957 | Brown | 252/174.24 |
| 2,979,466 | 4/1961 | Silberman | 252/138 |
| 3,060,124 | 10/1962 | Ginn | 252/135 |
| 3,133,024 | 5/1964 | Feierstein | 252/540 |
| 3,231,504 | 1/1966 | Marion et al. | 252/137 |
| 3,254,028 | 5/1966 | Wixon | 252/137 |
| 3,328,309 | 6/1967 | Grifo | 252/135 |
| 3,350,319 | 10/1967 | Schonfeldt | 252/138 |
| 3,509,059 | 4/1970 | Renold | 252/135 |
| 3,629,125 | 12/1971 | Payne | 252/135 |
| 3,639,288 | 2/1972 | Kerkhoven | 252/135 |
| 3,703,470 | 11/1972 | Brennan | 252/99 |
| 3,720,621 | 3/1973 | Smeets | 252/135 |
| 3,740,352 | 6/1973 | Sommers | 252/548 |
| 3,799,880 | 3/1974 | Kelly | 252/110 |
| 3,922,230 | 11/1975 | Lamberti | 252/539 |
| 4,082,684 | 4/1978 | Kreischer | 252/109 |
| 4,097,405 | 6/1978 | Watts | 252/316 |
| 4,147,650 | 4/1979 | Sabatelli et al. | 252/103 |
| 4,153,569 | 5/1979 | van den Brom | 252/109 |
| 4,175,062 | 11/1979 | Disch et al. | 252/540 |
| 4,215,004 | 7/1980 | Borgerding et al. | 252/156 |
| 4,228,048 | 10/1980 | Tesdahl | 252/135 |
| 4,244,840 | 1/1981 | Straw | 252/540 |
| 4,252,665 | 2/1981 | Casey | 252/106 |
| 4,284,533 | 8/1981 | Imamura | 252/542 |
| 4,302,347 | 11/1981 | Straw et al. | 252/116 |
| 4,325,829 | 4/1982 | Duggleby | 252/109 |
| 4,379,080 | 4/1983 | Murphy | 252/526 |
| 4,404,115 | 9/1983 | Tai | 252/135 |
| 4,446,043 | 5/1984 | Tai | 252/105 |
| 4,462,922 | 7/1984 | Boskamp | 252/174.12 |
| 4,490,271 | 12/1984 | Spadini | 252/174.23 |

FOREIGN PATENT DOCUMENTS

| | | |
|---|---|---|
| 623617 | 7/1961 | Canada . |
| 0038101 | 10/1981 | European Pat. Off. . |
| 870994 | 6/1961 | United Kingdom . |
| 2028365 | 3/1980 | United Kingdom . |

*Primary Examiner*—Dennis L. Albrecht

*Attorney, Agent, or Firm*—Frank Ianno; Eugene G. Seems

[57] ABSTRACT

A stable, homogeneous, aqueous detergent slurry is described containing polymeric acrylic stabilizers. The slurry contains about 14 weight percent to about 30 weight percent of a sodium polyphosphate, 0 to about 1 weight percent of sodium carboxymethylcellulose, 0 to about 5 weight percent of a compatible inorganic alkali metal hydroxide or salt as a viscosity modifier, a soluble nonionic surface-active agent in amounts of from about 13 weight percent to about 20 weight percent, a stabilizing amount ranging from about 0.4 to about 2 weight percent of a high molecular weight polymer of an acrylic acid, and wherein said sodium polyphosphate is present in part as insoluble particles having an average diameter of about 1 to about 10 microns.

13 Claims, No Drawings

HOMOGENEOUS LAUNDRY DETERGENT SLURRIES CONTAINING POLYMERIC ACRYLIC STABILIZERS

The present invention relates to built laundry detergent compositions, and specifically to such compositions which are stable, homogeneous slurries. In the detergent art, it is known that laundry formulations contain builders which enhance the cleaning ability of the formulation. The most popular of these builders, because of availability and cost, are sodium polyphosphates, of which sodium tripolyphosphate is the most commonly used.

The sodium polyphosphate builder, and particularly sodium tripolyphosphate, is known to function in laundry detergents in many ways to enhance the cleaning power of the detergents. For example, when dissolved in the aqueous medium in which clothes are being washed, it acts to sequester heavy metal ions thereby softening the water used for washing. The sodium tripolyphosphate functions cooperatively with the surfactants present in the detergent formulation to enhance the removal of oils and dirt particles from the garments being washed and helps to maintain these removed oils and particles in suspension as a fine emulsion or dispersed particles in the wash water. Thus, the sodium tripolyphosphate serves to increase the detergency function of the laundry formulation by maintaining the removed oils and particles dispersed in suspension so that they can be separated along with the wash water from the garments being cleaned.

The incorporation of sodium polyphosphates, such as sodium tripolyphosphate, in detergent compositions presents no problem when these compositions are in solid form. Almost any amount of sodium tripolyphosphate can be incorporated in solid detergent compositions, whether they be in form of the powders, granules or tablets, since the sodium tripolyphosphate can be made in bulk densities corresponding to the bulk density of the detergent composition. By this means, a homogeneous detergent composition is maintained regardless of the amount of sodium tripolyphosphate employed. Indeed, this is one of the reasons why such solid detergent compositions have been so popular and still comprise the bulk of the detergent formulations sold in the marketplace.

There is an increasing desire in the detergent industry to employ liquid detergent compositions instead of their solid counterparts because of the advantages the liquid compositions possess when compared with the solid formulations. The advantages of these liquid formulations include a positive means for mechanically dispensing measured doses in automatic washing machines compared with the solid compositions which give rise to blockages or residue in delivery tubes. The liquid formulations also eliminate dusting which often accompanies the measurement and dispensing of powdered laundry detergents. Caking of such powdered detergents is also encountered, which prevents proper dispensing. Another advantage is that the liquids are homogeneous and there is no problem with segregation of different ingredients that may have different sizes or specific gravities in the powdered laundry detergent. Still another advantage of the liquid detergent formulations is that they can be applied directly to soiled areas on the articles being cleaned to improve removal of localized, deeply embedded stains and dirt on any such garments.

One problem that has arisen in the use of these liquid detergent compositions is that popular builders such as the sodium polyphosphates, and in particular sodium tripolyphosphate, have a limited solubility in the aqueous composition on the order of about 14% by weight. This figure may be decreased substantially because of the addition of other ingredients to the composition, notably the presence of certain surface-active agents. This means that the amount of sodium tripolyphosphate desired to be added to the liquid detergent composition would exceed its solubility and would result in a composition which no longer is a purely liquid detergent composition. One way to overcome this problem is to use the potassium salt in place of the sodium salt of a polyphosphate, such as potassium tripolyphosphate, which is much more soluble than its sodium equivalent, and can be put in large amounts without exceeding its solubility limits. Another technique is to use sodium tripolyphosphate in combination with large amounts of soluble potassium salts, for example, potassium chloride, which also has the effect of solubilizing the sodium tripolyphosphate. Both of these techniques are undesired because of the high cost of either potassium tripolyphosphate or the potassium salts necessary to solubilize the sodium tripolyphosphate.

Another approach to this problem is to employ sodium tripolyphosphate in liquid detergents in excess of its solubility to form slurries, and to utilize such pourable slurries in the same way as a liquid detergent. This approach gives rise to two requirements. The first is that of keeping the undissolved sodium tripolyphosphate in a homogeneous suspension in the detergent slurry to insure uniform dispensing of the ingredients regardless of which portion (first or last) of the detergent slurry is dispensed. The second is to keep the detergent slurry stable so that separation of the aqueous phase from the surface-active agents does not occur. In general, substantial amounts of surface-active agents must be incorporated with the sodium tripolyphosphate in order to secure optimum cleaning with the slurry formulation and there is a tendency to obtain separation of these two liquid phases when the desired large amounts of surface-active agents, that is, about 13 weight percent to about 20 weight percent of the formulation, is included in such detergent slurry composition.

It has now been found that a stable, homogeneous, aqueous detergent slurry can be formulated containing polymeric acrylic stabilizers comprising:

a. a sodium polyphosphate in amounts of from about 14 weight percent to about 30 weight percent, b. sodium carboxymethylcellulose in amounts of from 0 weight percent to about 1 weight percent, c. a compatible, inorganic alkali metal hydroxide or alkali metal salt in amounts of 0 weight percent to about 5 weight percent as a viscosity modifier, d. soluble nonionic surface-active agents in amounts totaling from about 13 weight percent to about 20 weight percent, e. a high molecular weight polymer of an acrylic acid, in stabilizing amounts of from about 0.4 weight percent to about 2 weight percent, and f. said sodium polyphosphate being present in part as insoluble particles having an average diameter of about 1 to about 10 microns.

In the formulation of the present slurry, it is desired to have the undissolved sodium polyphosphate present in the form of insoluble particles having an average diameter of about 1 to about 10 microns. This size is desired to assure that any undissolved sodium polyphosphate will remain in the formulation as a homogeneous slurry that remains pourable. If the undissolved particles of sodium polyphosphate are too large, they will settle from the remainder of the formulation. If the particles are too small, they will form a gel-like mass that will not have the desired flow characteristics of a pourable liquid.

A preferred method for producing the present slurry formulation is to first dissolve the viscosity modifier, when this is desired for altering the final viscosity of the formulation. Such modifier, namely, an alkali metal salt or alkali metal hydroxide, is dissolved in amounts of from 1 weight percent to about 5 weight percent, in the requisite amount of water to form a solution containing an alkali metal ion, preferably sodium or potassium ion. To this solution is added, prefereably, 0.1 weight percent to about 1 weight percent of sodium carboxymethylcellulose (CMC) with stirring until dissolved. The addition of the CMC should precede addition of any insoluble polyphosphates to the formulation. However, the CMC can be added either prior to or after the addition of the alkali metal salt or hydroxide.

The alkali metal salt or alkali metal hydroxide which functions as a viscosity modifier, is used in amounts of from about 1 weight percent to about 5 weight percent, and preferably includes sodium carbonate, sodium hydroxide, potassium chloride, sodium chloride potassium carbonate, tetrapotassium pyrophosphate and potassium tripolyphosphate. Other alkali metal salts or hydroxides include potassium hydroxide, potassium bicarbonate, sodium sesquicarbonate, potassium sesquicarbonate, sodium borate, potassium borate, potassium sulfate, sodium sulfate, sodium orthophosphate and potassium orthophosphate.

The desired sodium polyphosphate, and preferably sodium tripolyphosphate, is then added in amounts of about 14 weight percent to about 30 weight percent. The added sodium polyphosphate dissolves up to the limit of its solubility and the remainder, which cannot stay dissolved, recrystallizes from the aqueous solution to form insoluble particles having an average diameter of about 1 to about 10 microns.

The sodium polyphosphate employed is preferably sodium tripolyphosphate but other polyphosphate mixtures can be employed such a tetrasodium pyrophosphate, and mixtures of sodium tripolyphosphate and tetrasodium pyrophosphate. When sodium tripolyphosphate is employed, the form known as Form I, that is containing at least 10% to 40% of Form I, is preferred for this purpose. If it is desired to use sodium tripolyphosphate which is essentially Form II sodium tripolyphosphate (that is containing less than 6% of Form I), it is more desirable if it is moisturized so that it contains at least about ½% by weight of water or above. For ease of dissolving, powdered sodium tripolyphosphate (typically 95 weight percent minimum −100 mesh) is preferred.

The mixing of sodium polyphosphate and the remaining ingredients of the slurry into the aqueous solution should be done with a high speed, high shear stirrer. Rapid agitation with high shear is desired during mixing of the sodium polyphosphate in the initial step and in the subsequent steps of adding the remainder of the ingredients to the slurry composition. The high shear action of the mixing stirrer is especially necessary to intimately mix the subsequently added surface-active agents with the aqueous portion of the slurry in order to obtain a slurry composition that is stable, so that separation of an aqueous phase from the surface-active agents does not occur.

After mixing of the alkali metal salt or alkali metal hydroxide, CMC and sodium polyphosphate, the next ingredient that is added, with high shear stirring, is one of the soluble nonionic surface-active agents described herein. The preferred nonionic surface-active agents employed are alcohol alkoxylates, for example, alkylphenol alkoxylates, and preferably alcohol ethoxylates or alcohol propoxylates. However, the alcohol structure may vary considerably in chain length. For example, surface-active agents such as Neodol ® 91-2.5 is the reaction product of a $C_9$–$C_{11}$ alcohol with an average of 2.5 moles of a ethylene oxide to form a polyethoxylate. Other similar nonionic surface-active agents which can be used include the following:

| Surface-Active Agent | Structure |
|---|---|
| Neodol ® 23-6.5 | $C_{12}$–$C_{13}$ alcohol ethoxylate (1 mole $C_{12}$–$C_{13}$ alcohol to 6.5 moles ethylene oxide) |
| Neodol ® 91-6 | $C_9$–$C_{11}$ alcohol ethoxylate (1 mole $C_9$–$C_{11}$ alcohol to 6 moles ethylene oxide) |
| Triton ® X-100 | octylphenyl ethoxylate (1 mole of octylphenol to 10 moles of ethylene oxide) |
| Neodol ® 25-7 | $C_{12}$–$C_{15}$ alcohol ethoxylate (1 mole $C_{12}$–$C_{15}$ alcohol to 7 moles ethylene oxide) |
| Neodol ® 25-9 | $C_{12}$–$C_{15}$ alcohol ethoxylate (1 mole $C_{12}$–$C_{15}$ alcohol to 9 moles ethylene oxide) |
| Neodol ® 45-13 | $C_{14}$–$C_{15}$ alcohol ethoxylate (1 mole of $C_{14}$–$C_{15}$ alcohol to 13 moles ethylene oxide) |
| Neodol ® 45-7 | $C_{14}$–$C_{15}$ alcohol ethoxylate (1 mole of $C_{14}$–$C_{15}$ alcohol to 7 moles of ethylene oxide) |

It is possible to mix the above soluble, nonionic alcohol alkoxylate surface-active agents, provided the total amount of such agents is from about 13 weight percent to about 20 weight percent of the slurry formulation The final required ingredient is a stabilizing amount of a high molecular weight polymer of an acrylic acid in amounts of from about 0.4 weight percent to about 2 weight percent. The "equivalent weight of solids" of the acrylic acid polymer is generally not above 150. The Illustrative of such compounds are Acrysol ® ASE-95 and Acrysol ® ASE-108. These have the following properties:

| | Acrysol ® ASE-95 | Acrysol ® ASE-108 |
|---|---|---|
| Solids content % | 20 | 20 |
| Polymer type | Not cross-linked, alkali soluble | Cross-linked, swellable |
| Emulsion type | Anionic | Anionic |
| pH | 3.0 | 3.0 |
| Sp. Gravity/25° C. | 1.050 | 1.046 |
| Density lbs/gal. | 8.75 | 8.71 |
| Viscosity (Brookfield, #1 Spindle, 12 rpm) cps/25° C., as supplied | 50 | 200 |
| As 1% sodium salt solution, cps/25° C. | 5600 | 2200 |

-continued

| | Acrysol ® ASE-95 | Acrysol ® ASE-108 |
|---|---|---|
| Equivalent weight of solids[1] | 123.5 | 124 |

[1](Weight of polymer solids equivalent to one equivalent of base, for example, 35 g $NH_4OH$)

The acrylic polymer can be added last or just prior to the addition of the nonionic surface-active agent.

In addition to the above ingredients, the slurry may also contain other well-known ingredients normally used in laundry detergents such as an anti-redeposition agents, optical brighteners, alkali silicates for corrosion control and enhanced cleaning, coloring agents, perfumes, foam depressants, enzymes and the like.

A typical formulation of the present invention is set forth below:

FORMULATION I

| Ingredient | Weight Percent (100% Active Compounds) |
|---|---|
| Sodium Carboxymethylcellulose (CMC) | 0.5 |
| Tetrapotassium Pyrophosphate (TKPP) | 4.0 |
| Pentasodium Tripolyphosphate (STPP) | 25.0 |
| Acrysol ® ASE-108[1] | 0.6 |
| Triton ® X-100[1] | 15.0 |
| Water | q.s |

[1]Acrysol and Triton are Rohm and Haas trademarks.

The liquid detergent formulation set forth in Formulation I was prepared in the following manner: a 1.5 kilograms batch of detergent slurry was prepared by charging 787.5 grams of deionized water into a clean 2-liter polyethylene vessel containing four baffles to enhance good mixing. The polyethylene vessel was provided with a variable speed mixer and a 2-blade high shear impeller. With the mixer set at medium speed, 7.5 grams of sodium carboxymethylcellulose (CMC) was added and mixed for 3 minutes. Following dissolution of the CMC, 60.0 grams of tetrapotassium pyrophosphate (TKPP) was added and mixed for 5 minutes at the same speed. After the TKPP was completely dissolved, 375.0 grams of Form I sodium tripolyphosphate powder (over 95 weight percent −100 mesh) was gradually added to the mixture and further mixed for 10 minutes while the stirrer was set at a higher speed setting. Thereafter, all other additions that followed were also performed with the stirrer at this higher speed setting. After completion of 20 minutes of sodium tripolyphosphate addition and mixing, 45.0 grams of Acrysol ® ASE-108, a 20% emulsion of an alkali-soluble acrylic polymer was added and mixed for 10 minutes. Thereafter, 225.0 grams of an octylphenol ethoxylate, Triton ® X-100 was added and mixed for 10 minutes. The resulting laundry detergent slurry was a stable, cream colored, opaque, homogeneous and pourable liquid. Upon extended storage for several months, the slurry remained homogeneous and pourable, and was stable without breaking up into distinct liquid layers of water and surface-active agents.

One of the advantages of the present slurries compared to the purely liquid laundry detergent formulations is the increased stability against hydrolysis which is imparted to the sodium tripolyphosphate. In general, sodium tripolyphosphate when dissolved in liquid detergent formulations will gradually hydrolyze to sodium orthophosphate over a period of time. This means that the formulations' shelf-life is limited since the formulation must be used prior to the hydrolysis of the sodium tripolyphosphate ingredient to obtain the benefit of the builder effect that sodium tripolyphosphate imparts to the formulation. In embodiments of the instant slurry formulation, the major proportion of sodium tripolyphosphate is present as an insoluble in the slurry. In this insoluble state, the sodium tripolyphosphate does not appreciably hydrolyze to sodium orthophosphate. The only portion of the sodium tripolyphosphate that is subject to some hydrolysis is the minor portion of sodium tripolyphosphate that remains dissolved in the slurry formulation. As a result, the present slurry formulation has a much greater shelf-life, from the point of view of stability of the sodium tripolyphosphate, than does the purely liquid detergent formulations. To this extent, the present slurry formulations exhibit the same desired hydrolytic stability of sodium tripolyphosphate as do dry formulations.

The following examples are given to illustrate the present invention and are not deemed limiting thereof. The formulations were prepared using essentially the same procedure as described above for preparing Formulation I. The stability tests for these formulations included one month of ambient shelf storage, followed by five freeze-thaw cycles, a high temperature storage and finally several months of ambient shelf storage. Each of the formulations, Runs 1–14, were pourable, homogeneous and stable.

Pursuant to the requirements of the patent statutes, the principle of this invention has been explained and exemplified in a manner so that it can be readily practiced by those skilled in the art, such exemplification including what is considered to represent the best embodiment of the invention. However, it should be clearly understood that, within the scope of the appended claims, the invention may be practiced by those skilled in the art, and having the benefit of this disclosure, otherwise than specifically described and exemplified herein.

TABLE I

| Ingredients | Runs 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| $H_2O$ | 59.0 | 54.0 | 54.5 | 54.5 | 54.5 | 54.5 | 53.2 | 52.5 | 52.5 | 52.5 | 52.5 | 52.5 | 52.5 | 52.5 |
| CMC | 1.0 | 1.0 | 0.5 | 0.5 | 0.5 | 0.5 | 0.5 | 0.5 | 0.5 | 0.5 | 0.5 | 0.5 | 0.5 | 0.5 |
| $Na_2CO_3$ | | | KCl[1] | NaCl[2] | $K_2CO_3$[3] | TKPP[4] | TKPP 60[4] | TKPP[4] | TKPP[4] | TKPP[4] | TKPP[4] | TKPP[4] | TKPP[4] | TKPP[4] |
| or other | 2.0 | 2.0 | 2.0 | 2.0 | 2.0 | 2.0 | 3.3 | 4.0 | 4.0 | 4.0 | 4.0 | 4.0 | 4.0 | 4.0 |
| STPP | 20.0 | 25.0 | 25.0 | 25.0 | 25.0 | 25.0 | 25.0 | 25.0 | 25.0 | 25.0 | 25.0 | 25.0 | 25.0 | 25.0 |
| Acrysol ® ASE-108 | 3.0 | 3.0 | | | | | | 3.0 | | | | | | |
| Acrysol ® ASE-95 | | | 3.0 | 3.0 | 3.0 | 3.0 | 3.0 | | 3.0 | 3.0 | 3.0 | 3.0 | 3.0 | 3.0 |
| Neodol ® 23-6.5 | 15.0 | | | | | | | | | | | | | |

TABLE I-continued

| Ingredients | Runs 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Neodol ® 91-6 | | 15.0 | | | | | | | | | | | | |
| Triton ® X-100 | | | 15.0 | 15.0 | 15.0 | 15.0 | 15.0 | 15.0 | | | | | | |
| Neodol ® 91-2.5 | | | | | | | | | 15.0 | | | | | |
| Neodol ® 91-6 | | | | | | | | | | 15.0 | | | | |
| Neodol ® 25-7 | | | | | | | | | | | 15.0 | | | |
| Neodol ® 25-9 | | | | | | | | | | | | 15.0 | | |
| Neodol ® 45-13 | | | | | | | | | | | | | 15.0 | |
| Neodol ® 45-7 | | | | | | | | | | | | | | 15.0 |

[1]2% potassium chloride (KCl) added in place of $Na_2CO_3$
[2]2% sodium chloride (NaCl) added in place of $Na_2CO_3$
[3]2% potassium carbonate ($K_2CO_3$) added in place of $Na_2CO_3$
[4]Tetrapotassium pyrophosphate (TKPP) added in indicated amounts, in place of $Na_2CO_3$

What is claimed is:

1. A stable, homogeneous aqueous detergent slurry comprising:

a. a sodium polyphosphate in amounts of from about 14 weight percent to about 30 weight percent, b. sodium carboxymethylcellulose in amounts of from 0 weight percent to about 1 weight percent, c. a compatible, inorganic alkali metal hydroxide or alkali metal salt in amounts of 0 weight percent to 5 weight percent, as a viscosity modifier, wherein said alkali metal salt is selected from the group consisting of sodium carbonate, potassium chloride, sodium chloride, potasium carbonate, tetrapotassium pyrophosphate, potassium tripolyphosphate, potassium carbonate, sodium sesquicarbonate, potassium sesquicarbonate, sodium borate, potassium borate, potassium sulfate, sodium sulfate, sodium orthophosphate and potassium orthophosphate, d. soluble, nonionic surface-active agents in amounts totaling from about 13 weight percent to about 20 weight percent, e. a high molecular weight polymer of an acrylic acid in stabilizing amounts of from about 0.4 weight percent to about 2 weight percent wherein said polymer has an equivalent weight of solids of about 123.5 to 150, is employed as an anionic aqueous emulsion having a solids content of about 20%, a pH of about 3, a viscosity of from about 50 to 200 cps which measured on a Brookfield No. 1 spindle at 12 rpm at 25° C., and a specific gravity at 25° C. of from about 1.050 to about 1.046, and f. said sodium polyphosphate being present in part as insoluble particles having an average diameter of about 1 to about 10 microns.

2. The detergent slurry of claim 1 wherein the sodium polyphosphate is sodium tripolyphosphate.

3. The detergent slurry of claim 1 wherein said alkali metal salt and alkali metal hydroxide are selected from the group consisting of sodium carbonate, sodium chloride, potassium carbonate and tetrapotassium pyrophosphate.

4. The detergent slurry of claim 1 wherein said alkali metal salt is sodium carbonate.

5. The detergent slurry of claim 1 wherein the soluble, nonionic surface-active agent is the reaction product of 1 mole of a $C_9$–$C_{11}$ alcohol with 6 moles of ethylene oxide.

6. The detergent slurry of claim 1 wherein the soluble, nonionic surface-active agent is the reaction product of 1 mole of a $C_{12}$–$C_{15}$ alcohol with 7 moles of an ethylene oxide.

7. The detergent slurry of claim 1 wherein the soluble, nonionic surface-active agent is the reaction product of 1 mole of octylphenol with 10 moles of an ethylene oxide.

8. The detergent slurry of claim 1 wherein the soluble, nonionic surface-active agent is the reaction product of 1 mole of a $C_{12}$–$C_{13}$ alcohol with 6.5 moles of ethylene oxide.

9. The detergent slurry of claim 1 wherein said soluble, nonionic surface-active agent is the reaction product of 1 mole of a $C_{12}$–$C_{15}$ alcohol with 9 moles of ethylene oxide.

10. The detergent slurry of claim 1 wherein the soluble, nonionic surface-active agent is the reaction product of 1 mole of a $C_{14}$–$C_{15}$ alcohol with 13 moles of ethylene oxide.

11. The detergent slurry of claim 1 wherein the soluble, nonionic surface-active agent is the reaction product of a $C_{14}$–$C_{16}$ alcohol with 7 moles of ethylene oxide.

12. The detergent slurry of claim 1 wherein said alkali metal salt or alkali metal hydroxide is present in amounts of from about 1 to about 5 weight percent.

13. The detergent slurry of claim 1 wherein said sodium carboxymethylcellulose is present in amounts of from about 0.1 to about 1 weight percent.

* * * * *